US005219163A

United States Patent [19]

Watson

[11] Patent Number: 5,219,163

[45] Date of Patent: Jun. 15, 1993

[54] FOAM BAT

[76] Inventor: H. Kirk Watson, 3 Fairmont St., Wethersfield, Conn. 06109

[21] Appl. No.: 880,502

[22] Filed: May 8, 1992

[51] Int. Cl.[5] ..... A63B 59/00

[52] U.S. Cl. ..... 273/67 R; 446/421; 446/473

[58] Field of Search ..... 273/67, 72, 266; 446/473, 402, 401, 421, 422

[56] References Cited

U.S. PATENT DOCUMENTS

| | | | |
|---|---|---|---|
| 2,967,710 | 1/1961 | Carlson | 273/72 R |
| 2,987,317 | 6/1961 | Acevedo | 273/67 R |
| 3,115,342 | 12/1963 | Webster | 273/26 R |
| 3,120,387 | 2/1964 | Weinstein | 273/26 R |
| 3,830,496 | 8/1974 | Reizer | 273/72 R |
| 3,921,978 | 11/1975 | Warren | 273/67 R |
| 4,014,542 | 3/1977 | Tanikawa | 273/72 R |
| 4,032,143 | 6/1977 | Mueller et al. | 273/72 R |
| 4,079,936 | 3/1978 | Schachter | 273/67 R |
| 4,118,030 | 10/1978 | Rander | 273/67 R |
| 4,328,966 | 5/1982 | Miyamoto | 273/67 R |
| 4,343,467 | 8/1982 | Newcomb et al. | 273/72 R |
| 4,351,786 | 9/1982 | Mueller | 273/72 R |
| 4,546,976 | 10/1985 | Jones | 273/72 R |
| 4,644,630 | 2/1987 | Blum | 273/72 R |
| 4,690,404 | 9/1987 | Yoder | 273/67 R |
| 4,705,273 | 11/1987 | Ament et al. | 273/72 R |
| 4,892,303 | 1/1990 | Lohre | 446/473 |
| 4,917,382 | 4/1990 | Hendershott | 273/72 R |

OTHER PUBLICATIONS

"*Boffers at Play*"; Family Weekly Dec. 21, 1975.

"*Sports*"; *My Weekly Reader* Jan. 27, 1971.

*Primary Examiner*—Mark Graham

*Attorney, Agent, or Firm*—Chilton, Alix and Van Kirk

[57] ABSTRACT

A rubber or plastic foam bat for recreational and/or therapeutic use. The bat includes a solid, generally cylindrical handle and a long, flexible tubular impact barrel longitudinally connected to the handle. The impact portion has a blind coaxial bore which closes momentarily when the bat strikes an object and subsequently reopens, thereby generating a loud noise. The bat preferably is formed from a thermoplastic or thermosetting material such as polyethylene.

8 Claims, 1 Drawing Sheet

FOAM BAT

BACKGROUND AND SUMMARY OF THE INVENTION

The invention relates generally to foam bats and more particularly relates to a flexible bat for use as a recreational toy and/or as a stress relieving device.

Various types of recreational bats are known, including bats that can be used to playfully strike another person. While many known bats are capable of providing the user with the satisfaction of striking another without causing pain or injury, none of the known toy bats of this type produce a loud, entertaining noise upon contact.

An object of the invention to provide a toy bat that will produce a loud clapping noise when it strikes a person or object.

Another object of the invention to provide a new and improved bat for indoor recreational us for playfully striking another without causing pain or injury.

Another object of the invention is to provide a bat having an elasticity which allows the bat to fold if too much force is applied too suddenly.

Yet another object of the invention to provide a bat-like device to relieve aggression and tension.

A further object of the invention to provide a bat of the type described which is simple and inexpensive to produce.

Other objects will be in part obvious and in part pointed out more in detail hereinafter.

The bat in a preferred form has a short, solid, generally cylindrical handle at one end and a long, semi-rigid tubular impact barrel at its other end. The impact barrel has a cylindrical outer surface and a blind coaxial bore. The bat is adapted to bend or fold at a fold point outwardly of the solid handle when the bat is used to strike a person or object with a predetermined minimum force. At the point of impact, while the bat is bent, the coaxial bore is at least partially closed off for an instant. When the bore reopens immediately after impact as the bat unfolds, a loud clapping noise is produced. The bat is formed from a soft material that will yield when the bat is used for playful hitting, in order to avoid pain or injury. Preferably, the bat is made of a thermoplastic or thermosetting foam.

The invention accordingly consists in the features of construction, combination of elements and arrangement of parts which will be exemplified in the construction hereafter set forth and the scope of the application which will be indicated in the appended claims.

DESCRIPTION OF THE PREFERRED EMBODIMENTS

Figure 1:
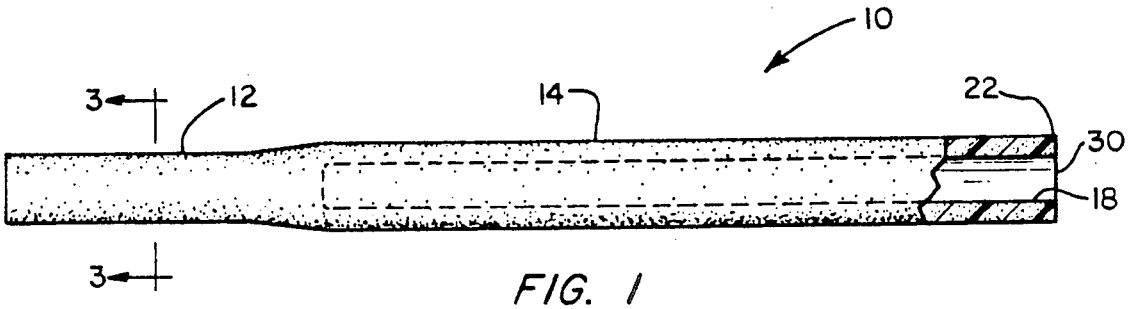
FIG. 1 is a side view of a bat according to the present invention.
Figure 2:
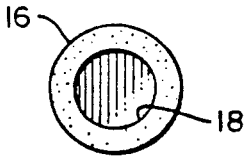
FIG. 2 is an end view of the outer end of the bat shown in FIG. 1.

Referring now to the drawings in detail wherein like numerals represent the same or like parts throughout, and referring particularly to FIGS. 1–2, an elongated bat 10 according to the present invention is shown comprising a short, elongated, solid handle 12 at one end and a long, flexible tubular impact barrel 14 at its other end. The impact barrel 14 has a cylindrical outer surface 16 and a coaxial blind bore 18 extending from an opening 20 at the outer end 22 of the barrel 14 along substantially the entire length of the barrel 14. The handle 12 and barrel 14 preferably are integrally formed from a single piece of plastic or rubber foam, and preferably are made of a thermosetting or thermoplastic polymer.

In the preferred embodiment, the handle 12 and barrel 14 have approximately the same diameter, although the diameter of the handle 12 is slightly smaller than the diameter of the barrel 14. In general, the diameters of the impact barrel 14 and the handle 12 can be different from each other, and can vary widely as long as the diameter of the handle 12 is appropriate for a child or adult to grip.

The handle 12 and barrel 14 can be of any suitable length, and are generally sized according to the height of the intended user, i.e., a small child's bat ordinarily would be smaller than a bat intended for an adult. The preferred embodiment of the bat 10 is about 36 inches long and 2 inches in diameter. The handle 12 itself preferably is about 10 inches long, and the barrel 14 preferably is about 26 inches long. The diameter of the coaxial bore 18 preferably is about 1 inch.

The bat 10 produces a loud, clapping noise when it strikes a person or an object with a reasonable swinging force. When the bat 10 impacts a person or object, it bends or folds along the barrel 14 between the handle 12 and the point of impact, causing air to be displaced from the bore 18 through opening 20 as the walls of the bore 18 collapse. Immediately after impact, air rapidly returns into the bore 18. The rapid filling of the semi-vacuum in the bore 18 is believed to be the source of the loud clapping sound which is produced when the bat 10 strikes an object. It is this loud sound which adds satisfaction to the use of the bat as a toy or a therapeutic device.

The bat 10 is formed from any plastic or rubber foam material having a softness and flexibility sufficient to cause the outer surface of the bat to yield when the bat is swung playfully to hit a person or object, thereby avoiding injury upon impact. The bat 10 is formed from a material which has a strength sufficient to maintain a bat-like shape when the device is not in use. Furthermore, the plastic or rubber foam material has an elasticity which causes the bat to fold, if too much force is applied to the handle too suddenly. Furthermore, the plastic or rubber foam material has an elasticity which causes the cylinder to collapse and resume its original shape immediately after impact. Preferably, the bat 10 is made from a thermoplastic or thermosetting material. For example, the bat 10 can be made of polyethylene, polypropylene, polychloride or a mixture thereof. For economic reasons, a polyethylene-based foam is preferred. According to a particularly preferred embodiment of the invention, the foam is polyethylene having a density of 8–21 lbs./cubic ft.

The bat 10 preferably is made by mixing a thermoplastic or thermosetting material, e.g., melted polyethylene, with a heat stabilizer and an impact modifier. A high vapor pressure system subsequently is added under pressure in order to dissolve the melt. The melt is then extruded through a die to form the bat 10. At atmospheric pressure, the plastic expands until it has cooled sufficiently to resist the internal vapor pressure of the high vapor pressure system.

The heat stabilizer is an material that will prevent depolymerization of the thermoplastic or thermosetting material. For example, tin oxalate can be used.

The impact modifier is incorporated in order to provide the bat with flexibility and elasticity and is preferably a material such as chlorinated polyethylene.

The high vapor pressure system causes the melt to dissolve under high pressure and to subsequently expand at atmospheric pressure. The high vapor pressure system can be, for example, freon, methylene chloride, or another high vapor pressure, halogenated hydrocarbon.

An alternative preferred method for producing the bat of the invention is to substitute a blowing agent for the high vapor pressure system. The blowing agent will generate inert gases on heating, causing the resin to foam. Suitable blowing agents include azides, which upon heating to over about 350° F. decompose to release nitrogen. The blowing agents preferably are used in conjunction with a resin formed from a thermoplastic or thermosetting polymer, a heat stabilizer and an impact modifier.

Figure 3:
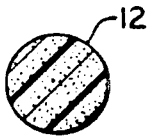
FIG. 3 is a transverse section view of the handle of the bat taken substantially along line 3—3 of FIG. 1.
Figure 4:
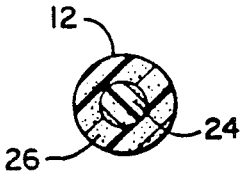
FIG. 4 is a transverse section view of an alternative handle for the bat according to the invention.

The handle 12 according to one preferred embodiment of the invention is of uniform composition throughout its thickness and length, as illustrated in FIG. 3. Alternatively, as illustrated in FIG. 4, the handle 12 can comprise a central core 24 and an outer tubular portion 26 which are formed from different compounds e.g., different thermoplastic or thermosetting materials having different degrees of softness and/or flexibility. While the impact portion 14 and handle 12 are preferably formed from the same type of material, different types of material e.g., material having different degrees of flexibility, can be used.

As will be apparent to persons skilled in the art, various modifications and adaptations of the structure above described will be readily apparent without departure from the spirit and scope of the invention, the scope of which is defined in the appended claims.

What is claimed is:

1. A foam bat, comprising:

a solid, generally cylindrical handle, and an elongated, semirigid impact barrel longitudinally connected to the handle, the impact barrel having a blind coaxial bore along its entire length, the bat being adapted to fold at a fold point outwardly of the handle to as least partially close off the bore momentarily when the bat strikes a person or object with a predetermined minimum force, and being adapted to subsequently unfold to reopen the bore after impact, the bat generating a loud noise caused by the re-entry of air into the bore as the bore reopens.

2. A bat according to claim 1, wherein the impact barrel comprises at least one of a thermoplastic and a thermosetting material.

3. A bat according to claim 2, wherein the handle comprises at least one of a thermoplastic and a thermosetting material.

4. A bat according to claim 1, wherein the handle has a substantially uniform composition.

5. A bat according to claim 1, wherein the handle has an inner core and an outer tubular portion, the inner core comprising the first material and the outer tubular portion comprising a second material, the first and second materials having different degrees of flexibility.

6. A bat according to claim 3, wherein the thermoplastic or thermosetting material comprises a member selected from the group consisting of polyethylene, polypropylene and polychloride.

7. A bat according to claim 3, wherein the impact barrel and handle comprise polyethylene.

8. A bat according to claim 1, wherein the handle and impact barrel are integrally formed as a single piece of foam.

* * * * *